United States Patent [19]

Warrix

[11] 4,273,341

[45] Jun. 16, 1981

[54] GAME APPARATUS INCLUDING PROJECTILE AND PIVOTAL TARGETS

[75] Inventor: John T. Warrix, Columbus, Ohio

[73] Assignee: Wolverine Toy Company, Booneville, Ark.

[21] Appl. No.: 121,375

[22] Filed: Feb. 14, 1980

[51] Int. Cl.[3] ..... A63F 9/02; A63F 7/02

[52] U.S. Cl. ..... 273/357; 273/121 R; 273/127 D; 273/392; 273/399

[58] Field of Search ..... 273/121 R, 127 D, 357, 273/399, 392, 355, 356

[56] References Cited

U.S. PATENT DOCUMENTS

| | | | |
|---|---|---|---|
| 2,127,276 | 8/1938 | Tratsch | 273/357 |
| 3,108,808 | 10/1963 | Peterson | 273/357 |
| 3,647,213 | 3/1972 | Baker | 273/355 |
| 4,177,992 | 12/1979 | Todokoro | 273/357 |
| 4,186,926 | 2/1980 | Kulesza et al. | 273/357 X |

FOREIGN PATENT DOCUMENTS

| | | | |
|---|---|---|---|
| 739456 | 10/1955 | United Kingdom | 273/121 R |

*Primary Examiner*—Anton O. Oechsle

*Attorney, Agent, or Firm*—Carothers and Carothers

[57] ABSTRACT

An amusement game device played by one or two persons and including an up-standing housing separated into left-hand and right-hand compartments by a vertical middle wall therebetween which is provided with a window for communication between the compartments. A pendulum is pivotally mounted in each compartment and each pendulum has an upwardly extending arm which extends above the pendulum pivot and a projectile target at the top of each arm. A launcher and a plurality of projectiles are provided for each compartment, and the pendulums are positioned within their respective compartments such that when a projectile is launched and thereby projects into the projectile target, the pendulum will pivot from the weight of the projectile resting in the target to dump the projectile into the compartment of the opponent through the aforesaid window in the center dividing wall.

4 Claims, 2 Drawing Figures

GAME APPARATUS INCLUDING PROJECTILE AND PIVOTAL TARGETS

BACKGROUND OF THE INVENTION

This invention relates generally to amusement devices and more particularly to a game device which is provided with projectiles and launchers for the projectiles and pivotal targets.

While there are many known forms of novelty devices utilizing projectiles and targets, there still exists a need for simple novelty devices which are inexpensive to manufacture, attractive in appearance, yet simple and easy to operate and which provide novelty action to retain continued interest of the game participants with the provision of movable or pivotal targets. One such game apparatus of the prior art is illustrated in U.S. Pat. No. 3,647,213 issued to Baker on Mar. 7, 1972, wherein there is disclosed a plurality of projectiles, a launcher and pivotal targets. It is a principle object of the present invention to provide an even more interesting and novel projectile game using pivotal targets in such a manner to increase the competitive interest in the game.

SUMMARY OF THE INVENTION

The amusement game device of the present invention generally comprises an up-standing housing which includes spaced front and back vertical walls joined by top, bottom and side walls. At least a portion of the front wall is formed of transparent material so that the game participants may see the interior of the housing. This game housing is internally separated into left and right compartments by a vertical middle wall, which middle wall is in turn provided with a window which gives communication between the left and right compartments. A plurality of projectiles, such as marbles, are provided in at least one of the compartments, and in addition, a pendulum is pivotally mounted in each compartment, and each pendulum has an upwardly extending arm which extends above the pendulum pivot and is provided with a projectile target at the top. Each compartment is also provided with a launcher for the projectile.

The pendulums are positioned within their respective compartments such that when a projectile is launched and thereby projected into the aforesaid target, the pendulum will pivot from the weight of the projectile resting in the target to dump the projectile into the other or opponent's compartment through the aforesaid window.

With two players, half the projectiles or balls are placed in each side or compartment, and the players attempt to launch the projectiles into the cup or target on top of the pendulum so that they will drop into the other side or compartment. The winner is the first one to get all of the projectiles into the opponent's compartment. With one player, the player will generally start with all of the projectiles on one side or compartment and play against time or the number of shots to get all the projectiles into the other side. As an alternative, when there is only one player, he may play his left hand against his right hand by using his respective hands to manipulate the respective projectile launchers.

The launching station is generally provided at the bottom of each of these left and right compartments for supporting the projectiles thereat, and the launching station is usually adapted to successively gravity feed the projectiles to the launcher for successive launching.

In the preferable embodiment, the launchers for the projectiles consist of pivotally mounted levers, with each lever having an inner portion thereof disposed respectively in the bottom of the compartments and the outer portion exposed from the housing for digital engagement by an operator.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENT

Figure 1:
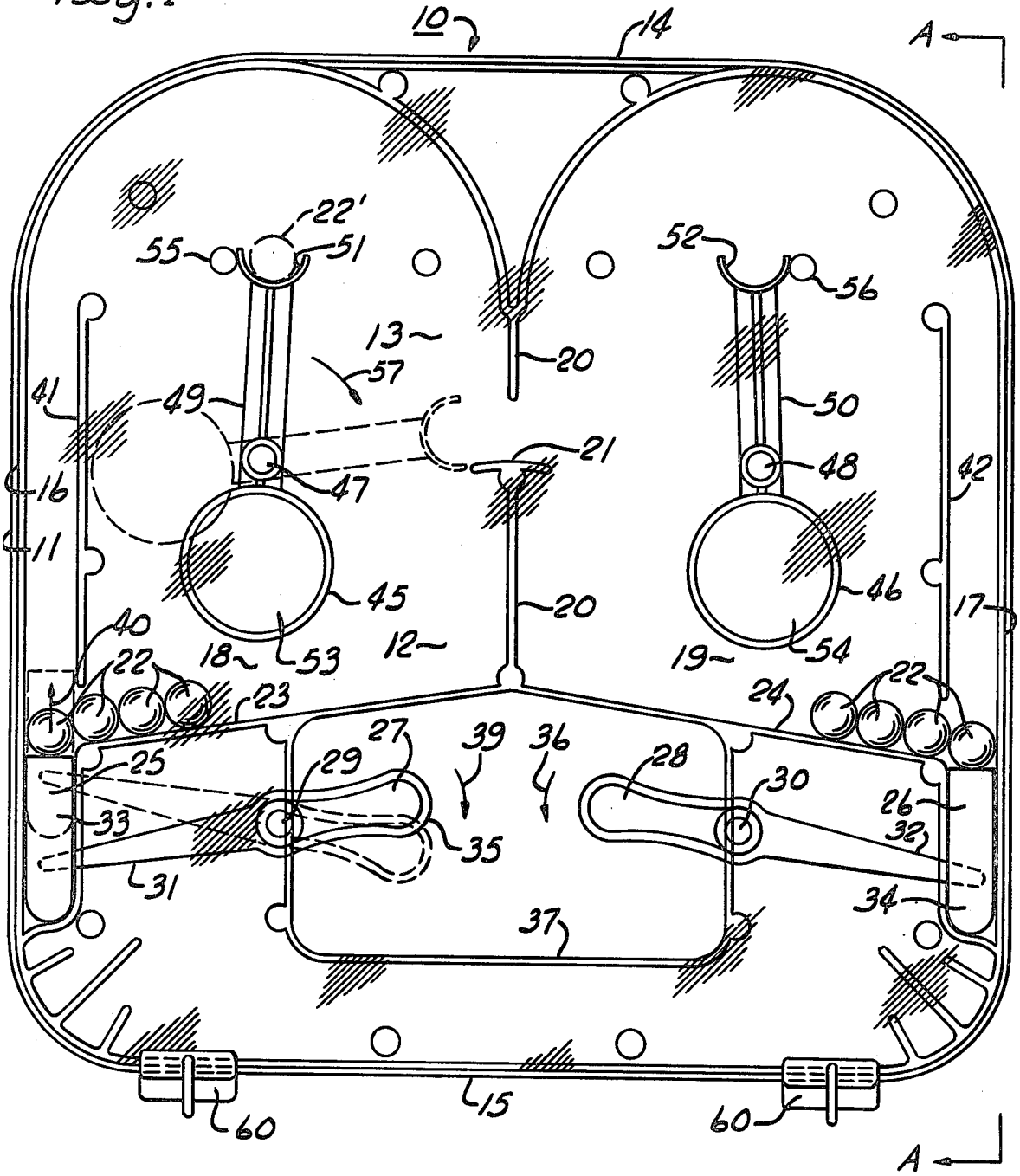
FIG. 1 is a view in front elevation of the preferred embodiment of the amusement game device of the present invention.
Figure 2:
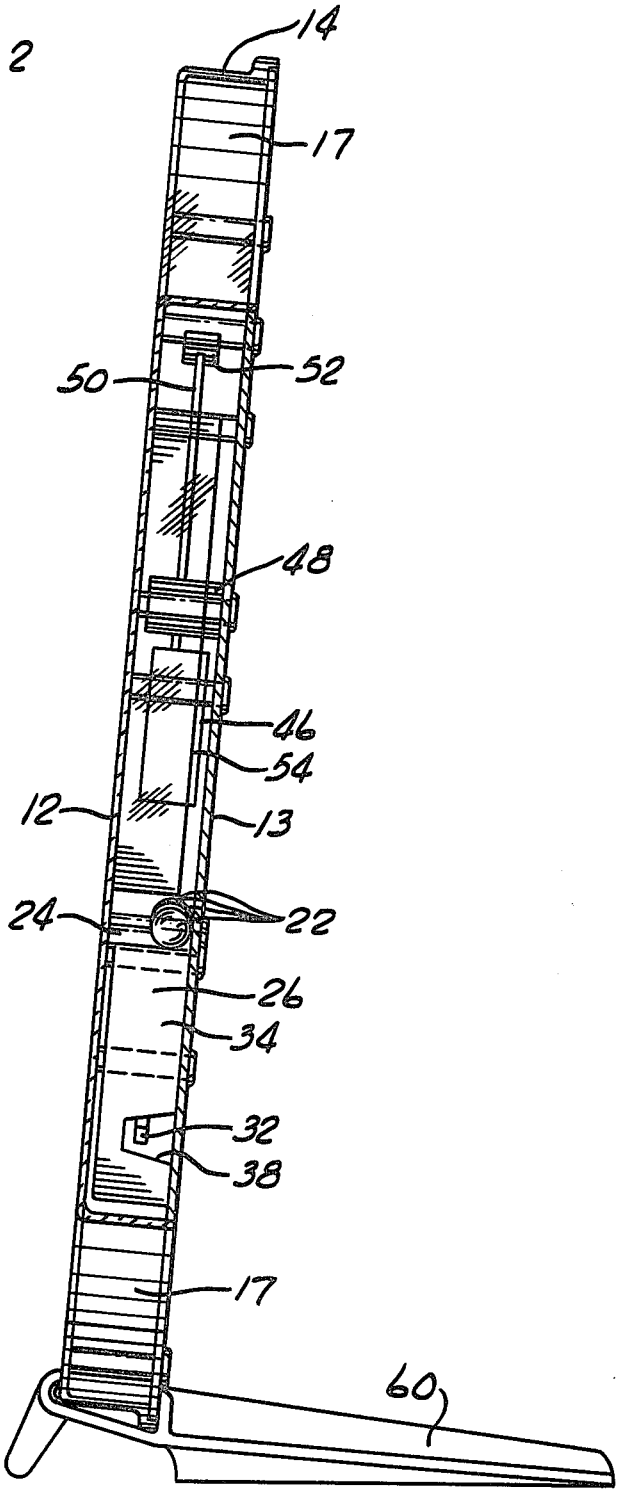
FIG. 2 is a view in side elevation of the amusement game device illustrated in FIG. 1 as seen in partial section along section line A—A.

Referring to the Figures, the amusement game device 10 of the present invention consists of up-standing housing 11 having spaced front and back vertical walls 12 and 13 respectively which are joined by top wall 14, bottom wall 15 and side walls 16 and 17. Front wall 12 together with top and bottom and side walls 14, 15, 16 and 17 are integrally molded of transparent plastic to permit viewing of the interior thereof. Back wall 13 is constructed of any inexpensive material such as cardboard, and may be provided with any desired amusing indicia or pictures.

Housing 11 is internally separated into left-hand compartment 18 and right-hand compartment 19 by means of the vertical middle wall 20. Vertical middle wall 20 is, in turn, provided with window 21 which provides communication between compartments 18 and 19.

Eight projectiles in the form of balls or marbles 22 are provided within the housing 11 and in the Figures, four of the projectiles 22 are provided in compartment 18 and four in compartment 19. Of course, any number of projectiles may be supplied. These projectiles rest at launching stations 23 and 24 at the bottom of the compartments 18 and 19 for supporting projectiles 22 thereat. These launching stations are merely the sloped surfaces 23 and 24 which are thus adapted to successively gravity feed projectiles 22 to launchers 25 and 26 respectively for successive vertical launching.

Launchers 25 and 26 each consist of pivotally mounted levers 27 and 28 which are pivotally mounted about pivot pins 29 and 30 respectively, and each of the levers 27 and 28 has inner portions 31 and 32 which engage pistons 33 and 34, respectively, for vertical movement of these pistons to launch a projectile 22. The levers 27 and 28 are also provided with outer portions 35 and 36 which are exposed from housing 11 by exposure window 37 in housing 11 for digital engagement by an operator or player. The inner portions 31 and 32 of levers 27 and 28 pass into windows or openings 38 of pistons 33 so that when outer portions 35 and 36 of levers 27 and 28 are moved downwardly as indicated by arrow 39, pistons 33 and 34 will respectively be pushed upwardly by the inner portions 31 and 32 of levers 27 and 28 as indicated by arrow 40 to launch or project the projectile 22 lying directly over the respective pistons up channels 41 or 42 into the upper portion of either compartment 18 or 19, as the case may be.

Thus, for example, if outer portion 35 of lever 27 is very quickly or rapidly smacked or pressed downwardly as indicated by arrow 39, the projectile 22 resting directly on top of piston 33 will be projected up into the upper part of compartment 18 of housing 11.

Pendulums 45 and 46 of identical construction are respectively provided in compartments 18 and 19. These pendulums are respectively pivoted about pivot pins 47 and 48 and each of the pendulums is provided with upwardly extending arms 49 and 50, respectively, which extend above the pendulum pivots 47 and 48. The top of arms 49 and 50 are in turn respectively provided with projectile cups or targets 51 and 52. Pendulums 45 and 46 are weighted with pendulum weights 53 and 54, respectively, at the bottom thereof to keep the pendulums in their vertical position as illustrated so that the targets or cups 51 and 52 respectively continue to engage stop pins 55 and 56.

Pendulums 45 and 46 are positioned within compartments 18 and 19 respectively such that when a projectile 22 is launched such as by launcher 25, and is thereby projected into the cup or target 51 such as indicated by the broken line outline of projectile 22', the pendulum 45 will pivot as indicated by arrow 57 from the weight of projectile 22' resting in target 51 to thus dump projectile 22' into compartment 19 through window 21.

Pendulum 46, of course, works in the same manner to dump projectiles through window 21 into compartment 18.

Thus, if two players are playing the game, they each manipulate their respective lever 27 and 28 and the winner of the game would be the first one to shoot all of his projectiles 22 into the respective pendulum cup or target on top of the pendulum such that they all drop into the other side or compartment. Of course, one person may play his left hand against his right hand, or he may position all of the projectiles 22 into one side and work against the clock or a predetermined number of shots in an attempt to get all of the balls into the other side or compartment.

In order to hold housing 11 in an upright position as illustrated, legs 60 are provided which readily snap onto the bottom of the housing 11 to hold it upright. These legs are also preferably molded of plastic.

I claim:

1. An amusement game device comprising:

an up-standing housing including spaced front and back vertical walls joined by top, bottom and side walls;

said front wall formed at least in part of transparent material;

said housing internally separated into left and right compartments by a vertical middle wall;

a window in said middle wall providing communication between said compartments;

a plurality of projectiles in at least one of said compartments;

a pendulum pivotally mounted in each compartment and each having an upwardly extending arm which extends above the pendulum pivot and a projectile target at the top of each of said upwardly extending arms;

a launcher in each of said compartments for launching one of said projectiles;

said pendulums positioned within said compartments such that when a projectile is launched and thereby projected into said target, said pendulum will pivot from the weight of said projectile resting in said target to dump the projectile into the other compartment through said window.

2. The amusement game device of claim 1 including a launching station at the bottom of each of said compartments for supporting said projectiles thereat and adapted to successively gravity feed said projectiles to said launchers for successive launching.

3. The amusement game device of claim 2 wherein said launchers consist of pivotally mounted levers, each having an inner portion thereof disposed respectively in the bottom of said compartments and an outer portion exposed from said housing for digital engagement by an operator.

4. An amusement game device comprising:

an up-standing housing including spaced front and back vertical walls joined by top, bottom and side walls;

said front wall formed at least in part of transparent material;

said housing internally separated into left and right compartments by a vertical wall;

a window in said vertical wall providing communication between said compartments;

a plurality of projectiles in one of said compartments;

a pendulum pivotally mounted in said one compartment and having an upwardly extending arm which extends above the pendulum pivot and a projectile target at the top of said upwardly extending arm;

a launcher in said one compartment for launching a projectile within said one compartment;

said pendulum positioned within said one compartment such that when a projectile is launched and thereby projected into said target, said pendulum will pivot from the weight of said projectile resting in said target to dump the projectile into the other compartment through said window.

* * * * *